US008406378B2

(12) United States Patent
Wang et al.

(10) Patent No.: US 8,406,378 B2
(45) Date of Patent: Mar. 26, 2013

(54) THICK TARGETS FOR TRANSMISSION X-RAY TUBES

(75) Inventors: Chia-Gee Wang, New York, NY (US); Bruce Briant Parsons, Taipei (TW)

(73) Assignee: GAMC Biotech Development Co., Ltd., New Taipei (TW)

( * ) Notice: Subject to any disclaimer, the term of this patent is extended or adjusted under 35 U.S.C. 154(b) by 224 days.

(21) Appl. No.: 12/806,976

(22) Filed: Aug. 25, 2010

(65) Prior Publication Data

US 2012/0051496 A1 Mar. 1, 2012

(51) Int. Cl.
*H01J 35/00* (2006.01)

(52) U.S. Cl. ..... 378/121; 378/140; 378/143

(58) Field of Classification Search ..... 378/42, 378/62, 121, 140, 143
See application file for complete search history.

(56) References Cited

U.S. PATENT DOCUMENTS

| | | | |
|---|---|---|---|
| 4,034,251 | A | 7/1977 | Haas |
| 4,583,243 | A | 4/1986 | Diemer et al. |
| 4,622,688 | A | 11/1986 | Diemer et al. |
| 4,646,338 | A | 2/1987 | Skillicorn |
| 4,701,941 | A | 10/1987 | Szirmai et al. |
| 7,154,992 | B2 | 12/2006 | Schuster |
| 7,180,981 | B2 | 2/2007 | Wang |
| 7,215,741 | B2 | 5/2007 | Ukita |
| 7,356,119 | B2 | 4/2008 | Anno |
| 7,430,276 | B2 | 9/2008 | Wang et al. |
| 7,634,052 | B2 | 12/2009 | Grodzins et al. |
| 7,738,632 | B2 | 6/2010 | Popescu et al. |
| 7,981,928 | B2 | 7/2011 | Wang et al. |
| 7,983,394 | B2 | 7/2011 | Kozaczek et al. |

FOREIGN PATENT DOCUMENTS

| | | |
|---|---|---|
| JP | 6260121 | 9/1994 |
| WO | 03088302 | 10/2003 |
| WO | 2006069009 | 6/2006 |
| WO | WO 2006069009 A2 * | 6/2006 |

OTHER PUBLICATIONS

Ihsan, Optimization of X-ray target parameters for a high-brightness microfocus X-ray tube; Nucl. Inst. and Meth. in Phys. Res. B 264 (2007) 371-377.

Heo, Transmission-type microfocus x-ray tube using carbon nanotube field emitters; Appl. Phys. Lett. 90 183109 (2007).

"International Search Report of PCT Counterpart Application", issued on Mar. 29, 2012, p. 1-p. 12, in which the listed references were cited.

* cited by examiner

*Primary Examiner* — Courtney Thomas
(74) *Attorney, Agent, or Firm* — Jianq Chyun IP Office

(57) ABSTRACT

This invention relates to the use of thick target materials 50 microns and thicker for an x-ray transmission tube; to possible target material compositions including various elements and their alloys, eutectic alloys, compounds, or intermetallic compounds; and applications for utilizing such thick target transmission x-ray tubes. The target comprises at lease one portion of the target with a thickness of 50 microns or greater. The target can be optionally attached to a substrate end-window essentially transparent to x-rays or be thick enough so that no such substrate is required. Applications include producing a high percentage of monochromatic line mission x-rays of said thick target for use in reduced dose medical imaging and other non-destructive testing applications.

20 Claims, 9 Drawing Sheets

THICK TARGETS FOR TRANSMISSION X-RAY TUBES

FIELD OF THE INVENTION

This invention generally refers to an improved way of producing x-rays from a transmission x-ray tube which significantly reduces unwanted low energy x-rays while proportionally enhancing higher energy characteristic line emissions from the target. Specifically it relates to using thick transmission targets, greater than about 50 microns. The invention includes various applications of the invention in various medical and dental imaging, fluoroscopy, and non-destructive testing applications.

DESCRIPTION OF RELATED ART

U.S. Pat. No. 7,180,981 dated Feb. 20, 2007, enclosed herein its entirety for reference, discloses end window x-ray tubes with target foils up to a maximum of 41 microns thick. 41 microns of target material offers filtering of some of the x-rays generated in the low energy range depending on the target material used. Yet there is still significant low energy x-ray generation which cause still too much dose to patients in medical x-rays, or provide unwanted low energy x-rays which must be removed in applications such using x-ray tubes for x-ray microscopy, x-ray fluorescence or x-ray diffraction wherein the lower x-rays must be removed.

In U.S. Pat. No. 7,180,981 data was shown for two different target thickness of silver targets in a transmission tube, one 25 microns thick and one 41 microns thick. Comparing FIGS. 5A-5D for spectrum from a silver target 25 microns thick to FIGS. 17*a*-17*d* of a silver target 41 microns thick, the output flux is considerably higher from the 25 micron target than the data from 41 micron thick silver target. Hence the data from the prior art teaches what is commonly accepted by those skilled in the art, that is as transmission target thickness increases the thicker target absorbs x-rays produced when the electrons first enter the target. Hence, a target of 41 micron thick silver produces considerably poorer flux than a target of 25 microns. Although data from a target 41 microns thick was included in the patent, nothing was mentioned about what market such a target might address. Clearly from the data the 25 micron thick silver target produced superior spectral data.

It is the common sense of experts in the field that most x-rays are produced by electrons within the first several microns of entry into the target material and thicker transmission targets will degrade the quality of the x-ray beam generated by absorbing x-rays already generated as the x-rays pass through the target. Hence in commercially available x-ray tubes the thickness of the transmission tube, most of which use tungsten targets, is generally confined to 8 microns or thinner.

PENELOPE, maintained at the OECD Nuclear Energy Agency in France, is a general-purpose Monte Carlo software tool widely used for simulating the transport of electrons and photons as electrons enter an x-ray target. Experimental situations amenable to detailed simulation are those involving either electron sources with low initial kinetic energies (up to about 100 kVp) or special geometries such as electron beams impinging on thin foils. For larger initial energies, or thick geometries, the average number of collisions experienced by an electron until it is effectively stopped becomes very large, and detailed simulation is very inefficient. PENELOPE is thus not capable of providing reliable simulations when a thick transmission target is involved or when the accelerating voltages for the impinging electrons exceed 100 kVp. Hence there is no reliable simulation tool to predict the results of using thick transmission targets, especially when those targets may use accelerating voltages above about 100 kVp. Other simulation packages have been mentioned in the literature, but little is know about the assumptions they use to produce output spectrum, if they produce such spectrum at all.

In a paper entitled "Transmission-type Microfocus X-ray Tube Using Carbon Nanotube Field Emitters, published in Applied Physics Letters 90, 183109_2007_ the authors disclosed, " . . . as the thickness of the target material increases, x-ray attenuation becomes significant during the penetration of x rays through the target. On the basis of the calculation result, the coating thickness of W on the Be window was determined to be 1.1 micrometers to produce maximum x-ray intensity at 40 keV electron energy." This supports the belief of those skilled in the art that transmission targets should be thin foils.

Many applications of x-rays exist where low energy x-radiation is an unwanted byproduct of producing useful x-rays at higher energy needed for imaging, for x-ray diffraction analysis or for x-ray microscopy. In medical applications low energy x-radiation is absorbed by the patient without producing useful images and hence becomes unwanted additional dose.

Monochromatic x-rays are often generated using x-rays from conventional sources for industrial uses. Yet the monochromatic component of the wide energy band x-rays produced with conventional reflection and transmission x-ray tube sources requires considerable effort and expense to convert to useful monochromatic x-rays. Such monochromatic x-rays are often used for crystal diffraction and x-ray microscopy. When there is a considerable amount of low energy x-radiation, the cost of producing monochromatic x-ray energies increases.

In medical imaging applications using reflection type x-ray tubes unwanted, low energy x-rays can be filtered by a filter placed external to the x-ray tube. Such filters reduce proportionally more low energy x-rays than higher useful x-rays however there is a limit of how much x-rays can be filtered before, the focal spot size that can be obtained and the amount of energy that can be removed from the spot on the target where the beam impinges cause damage to the target. Further it is well known that for the same amount of tube current and tube voltage, transmission tubes produce many times more total useful x-rays than are produced by reflection type tubes.

What is needed is a way to reduce the dose that patients see without reducing or with actually improving the quality of the images produced by medical imaging x-radiation. A conventional source of x-rays is needed that produces a high quantity of characteristic x-radiation to be further converted into high intensity quasi-monochromatic x-rays for many industrial and medical applications.

SUMMARY OF THE INVENTION

An end window, transmission type x-ray tube is disclosed comprising an evacuated tube housing, an end window anode disposed in the housing having a foil or plurality of foil targets, a cathode disposed in the housing emitting an electron beam with energies of 10 kVp to 500 kVp which proceeds along the beam path striking the anode in a spot and generating a beam of x-rays which exit the housing through the end window. A power supply is connected to the cathode providing selectable electron beam energies to produce a bright beam of x-rays of at least one pre-selected energy characteristic of the thick target foil or foils. The thickness of at least one of the target foils is greater than about 50 microns and can be as thick as 200 microns or more. When the same material is used for the target and the end-window the total thickness of the target/end-window can be as high as 500 microns.

A target formed by attaching the thick foil to the substrate through diffusion bonding, through hot pressing or through hot isostatic pressing. The substrate material is substantially transparent to x-rays and is selected from beryllium, aluminum, copper, lithium, boron, or alloys thereof.

The target foil can alternatively by made from an alloy, eutectic alloy, compound or intermetallic compound of two or more elements that produce useful characteristic x-ray line emissions from at least one of the elements. The material used for the x-ray target may contain one of the elements scandium, chromium, antimony, titanium, iron, nickel, yttrium, molybdenum, rhodium, palladium, gadolinium, erbium, ytterbium, copper, lanthanum, tin, thulium, tantalum, tungsten, rhenium, platinum, gold and uranium.

The electron beam may be focused above, below or onto the target by a focusing mechanism. The target may be attached to an end window of a different material such as beryllium, aluminum, copper or their alloys.

Applications for use of the above described transmission tube include using the tube to obtain dental CT images, medical images, computed tomography images, x-ray diffraction patterns, C-Arm images, fluoroscopic images and x-ray microscopy.

Two applications of the above technology for are x-ray imaging and fluorescence analysis utilizing collimation of the x-rays to guide the path of the x-rays to the object to be examined.

A single glass capillary or a bundle of glass capillaries placed in close proximity to the end window maybe used to guide at least a part of the output x-rays to the other end of the capillary or bundle of capillaries for use in fluoroscopy and industrial imaging applications.

Another application of transmission tubes with thick target foils is to examine objects by an in-line, automated material handling apparatus.

DETAILED DESCRIPTION OF THE INVENTION

Open transmission tubes are typically used for imaging of electronic circuits as well as other high-resolution applications and may alternatively be used as the x-ray source when high multiplication factors are required of the object's image. Closed tubes are sealed with a vacuum whereas open or "pumped down" tubes have a vacuum pump continuously attached drawing a vacuum as the tube is used usually to allow for frequent replacement of tube parts which tend to fail in operation. For purposes of this invention transmission tubes include both open and closed transmission type tubes except as otherwise stated.

Unless otherwise specified x-ray tube spectral data was taken with an Amptek Model XR-100 with a CdTe sensor 1 mm thick and 10 mils of Be filter. The sensor was placed at a distance of 1 meter from the x-ray tube and a tungsten collimator with a collimator hole of 100 μm diameter placed in front of the sensor. Various tube currents and exposure times were used but comparison data has been normalized to 50 microamps of tube current and a collection time of 60 seconds.

For purposes of this invention electron accelerating voltages are expressed in kVp and range from 10 kVp to 500 kVp. No attempt has been made to include electron accelerating voltages in excess of 500 kVp. Additionally the energy of x-ray photons is expressed in kev, kilo-electron volts.

Figure 1:
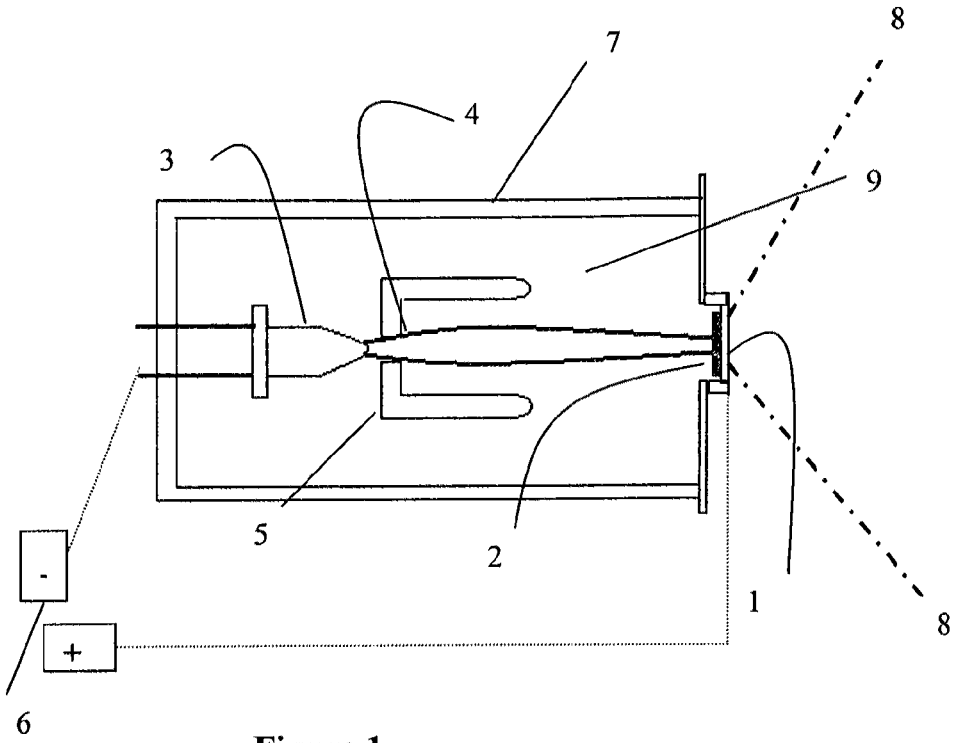
FIG. 1 is a schematic, elevational, cross sectional representation of a transmission x-ray tube of the current invention.

The transmission tube of the current invention, Item 7, of FIG. 1 is comprised of an evacuated housing Item 9, and end-window anode, Item 1, disposed at the end of the housing exposed to atmosphere. An x-ray target foil, Item 2, is deposited on the end-window anode. An electrically stimulated cathode, Item 3, emits electrons, which are accelerated along the electron beam path, Item 4, and strike the anode target producing x-rays, Item 8. A power supply, Item 6, is connected between the cathode and anode to provide the accelerating force for the electron beam. X-rays produced exit the x-ray tube through the end-window. The end-window material is typically chosen from one of beryllium, aluminum, copper, lithium, boron and alloys thereof, but there are alternative low end-window materials well known to those skilled in the art. The thickness of the end-window material can be tailored to specific applications. An optional focusing cup, Item 5, typically electrically biased, focuses the electron beam above, below or onto a spot on the target. The largest dimension of the spot on the surface of the target is referred to as the focal spot size or spot size. The output x-rays contain both bremsstrahlung (or braking radiation) and characteristic line radiation unique to the target material. Prior art specifies that the thickness of the target foil can be as thick as 41 microns. In one preferred embodiment of the current invention a transmission type x-ray tube utilizes a target foil considerably thicker than previously disclosed, thicker than 50 microns and as thick as 200 microns.

Figure 2:
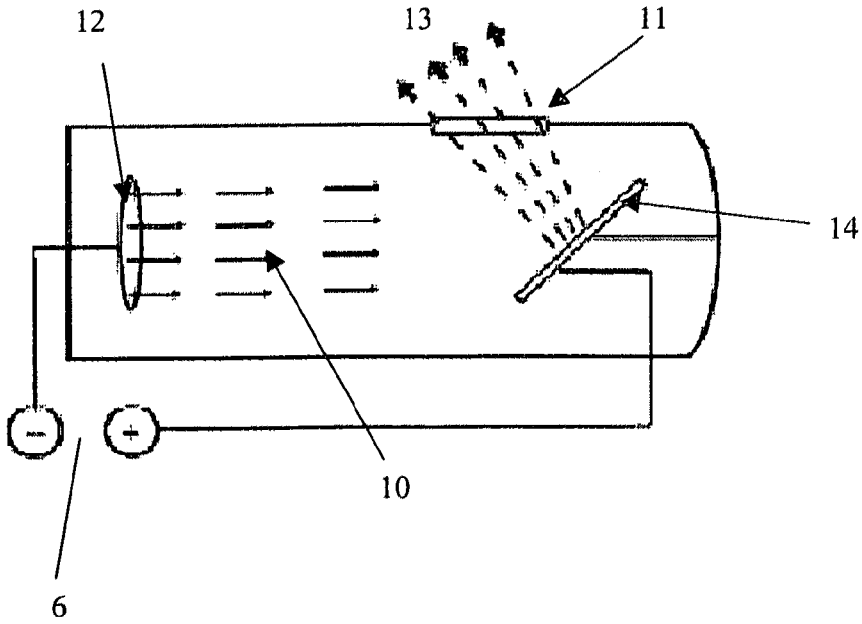
FIG. 2 is a schematic, elevational, cross sectional representation of a reflection type x-ray tube.

FIG. 2 is provided for reference and schematically represents a reflection tube comprised of an evacuated housing in which the cathode Item 12 and anode Item 14 are located. The anode Item 14 is comprised of an x-ray target deposited onto a substrate which substrate removes heat generated when x-rays impinge the anode. Electrons are emitted from the cathode in any way known to those skilled in the art. A power supply Item 6 is connected between the cathode and the anode to provide an electric field which accelerates the electrons from the cathode along an electron beam path Item 10 and strikes the anode Item 14 in a spot generating a beam of x-rays Item 13 which then exit the tube through a side window Item 11. The reflection tube harvests produced x-rays from the same side of the target that the electron beam impinges.

Figure 3:
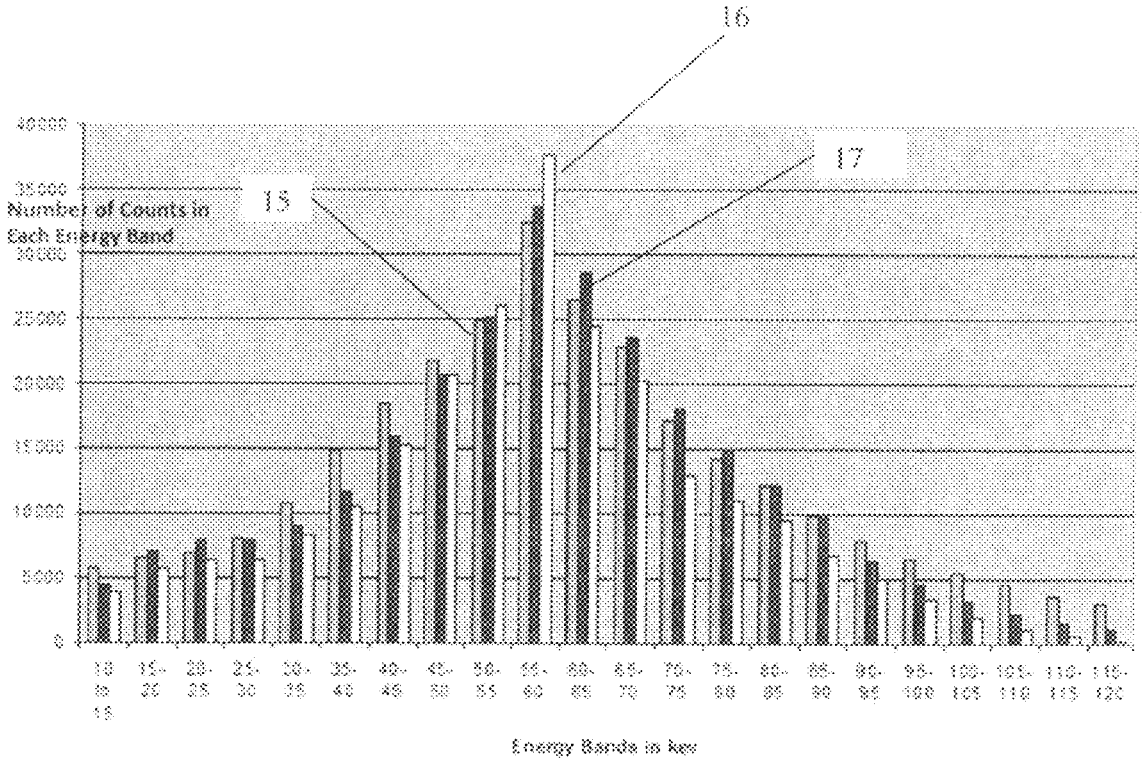
FIG. 3 is a graphical representation of the number of photons generated in each of three different x-ray tubes, one reflection type and two transmission type with different target configurations.

FIG. 3 illustrates the spectral output of three different x-ray tubes. All three tubes have been normalized to the same number of photon counts between critical x-ray energies of 40 and 70 kev and are filtered by a filter typically used in the Dental CT imaging market but also very similar to tubes used for other applications in medical imaging including C-arm instruments. In the C-arm instrument the x-ray source and image receptor are at opposite ends facing each other along the direction of the centerline of the x-ray tube. The low dose of the current invention is especially attractive in C-arm applications where the patient is often radiated by x-rays for long periods of time. Item 15 represents the output spectrum of a reflection type x-ray tube operated at 3 milliamps tube current and a tube voltage of 120 kVp using a target material of tungsten. Item 17 represents the output spectrum of a transmission type tube of the prior art with a foil thickness of 25 micrometers of tantalum operated at 1.2 milliamps of tube current. Item 16 represents the output of a transmission type tube of the current invention with a foil thickness of 50 micrometers of tantalum operated at a tube current of 1.35 milliamps. As expected the number of counts from the transmission type tubes are considerably higher for the same tube current than the reflection type tube. An examination of total unwanted dose of x-rays between 10 and 40 kev shows that the total photon counts between 10 and 40 kev for the reflection type x-ray tube with a tungsten target was 52,763 counts. The same amount of total photon counts for the transmission tube with a tantalum target thickness of 25 microns was 47,740 between 10 and 40 kev, representing a reduction of 9.5% in low energy x-rays. Examining the amount of total counts for a tantalum target of 50 micron thickness, shows a reduction when compared to the reflection type tube there of 21.8% in the flux in the photon energies from 10 to 40 kev over that of the reflection type x-ray tube. Filtering was identical for all three tubes.

Figure 4:
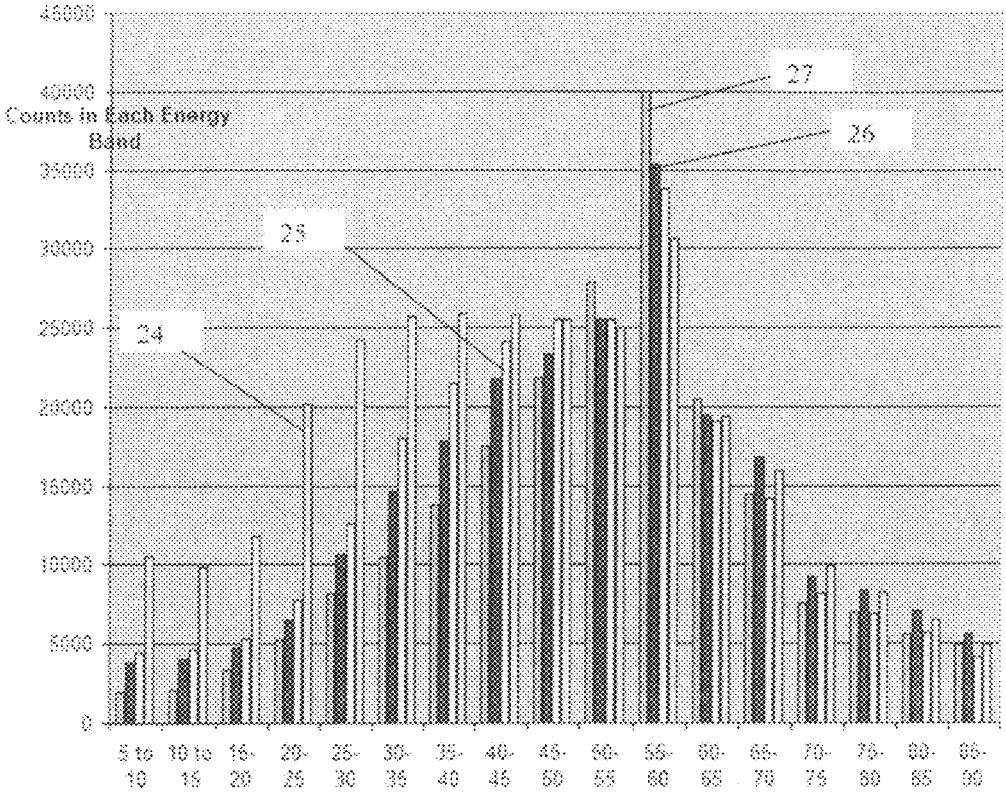
FIG. 4 is a graphical comparison of the spectrum of four transmission tubes, three of which are of the current invention.

FIG. 4 shows the distinct advantages of using an x-ray tube of the current invention to obtain medical and dental images as well as other non-destructive testing applications using tantalum targets 25 (Item 24), 50 (Item 25), 65 (Item 26) and 130 (Item 27) microns thick operated at a tube voltage of 120 kVp. All data has been normalized. The total flux between 40 and 70 kev has been set equal to that of the tantalum tube with 50 micron thick target material. In practice this is equivalent to changing the tube current until the flux for each tube is equal to the flux of the tube with a target 50 microns thick. As the target thickness increases the amount of dose below 40 kev is dramatically reduced by the thicker target. At the same time high energy radiation (from about 70 kVp to 120 kVp) is not substantially increased and in most cases even lower. This is especially useful in medical imaging, dental computed tomography (CT) imaging, medical CT imaging, and C-arm imaging markets as will be obvious to those skilled in the art. Although the preferred embodiment used tantalum as the target material, other target materials may be used providing different spectrum characteristics as needed for specific applications of the current invention. Reduction of the x-radiation below 40 kev will reduce the amount of x-rays that are absorbed by the body in medical imaging applications causing tissue damage without adding to the quality of the x-ray image. The extra amount of radiation between k-line characteristic energies and k-edge of the target material with the thicker targets will provide considerable improvement of image quality as the target becomes thicker. This data clearly shows the advantages of using a target thickness 50 microns and thicker.

TABLE 1

| Target Material/Thickness | Angle from Centerline | Total Number of Counts |
|---|---|---|
| 2Ta 60 kVp 50 microamps | 0 Degrees | 228,673 |
| 2Ta 60 kVp 50 microamps | 60 Degrees | 192,064 |
| 2Ta 60 kVp 50 microamps | 80 Degrees | 123,670 |
| 4Ta 60 kVp 50 micoramps | 0 Degrees | 167,290 |
| 4Ta 60 kVp 50 micoramps | 60 Degrees | 113,417 |
| 4Ta 60 kVp 50 micoramps | 80 Degrees | 53,872 |

Figure 5:
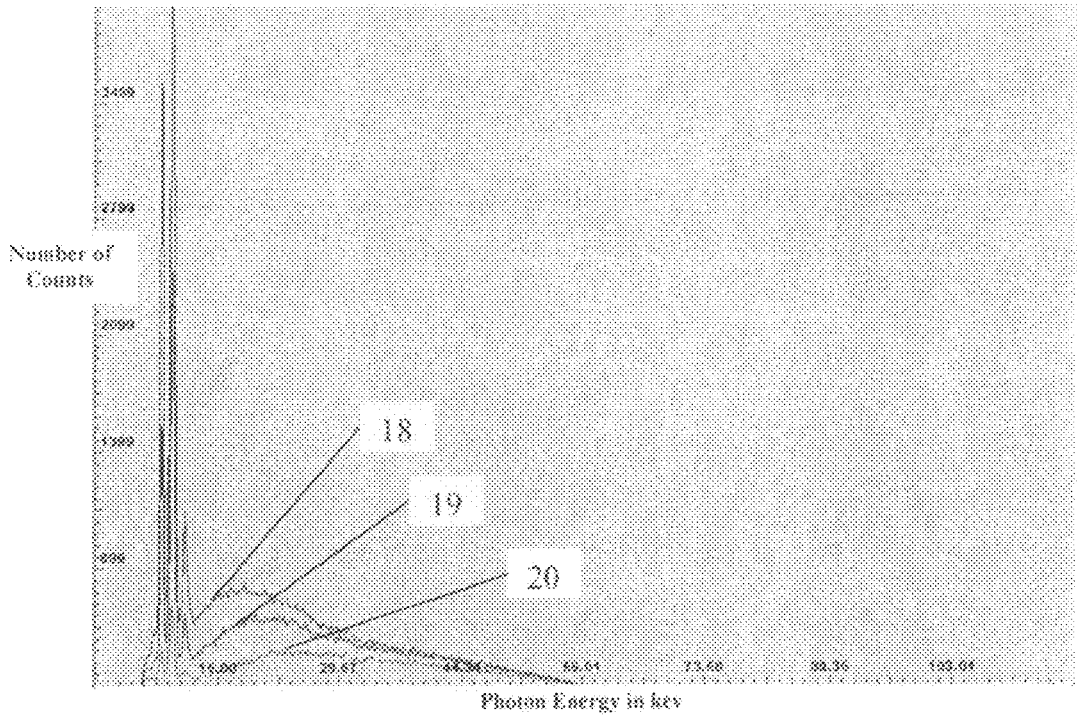
FIG. 5 is a graphical representation of the spectrum from a single transmission type x-ray tube with a tantalum target 4 microns thick at different angles from centerline.
Figure 6:
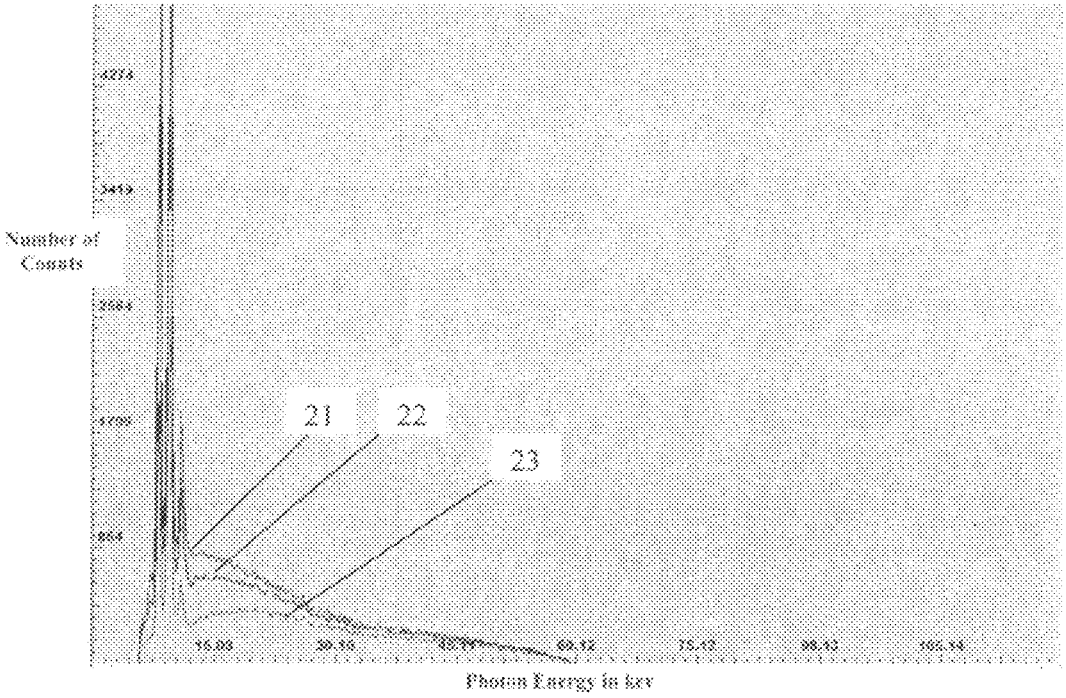
FIG. 6 is a graphical representation of the spectrum from a single transmission type x-ray but with a tantalum target 2 microns thick at different angles from centerline.

FIG. 5 illustrates the output flux from a transmission tube with a tantalum target 4 microns thick with x-ray flux measured at centerline (0 degrees) Item 18, 60 degrees from centerline Item 19 and 80 degrees from centerline Item 20. The thickness of the tantalum target at 0 degrees is 4 microns, at 60 degrees the thickness has an apparent increase to 80 microns and at 80 degrees to more than 20 microns. FIG. 6 is a graphical representation of the output flux from a transmission tube with a target thickness of 2 microns measured at centerline Item 21, at 60 degrees Item 22 and 80 degrees Item 23. Table 1 shows the relative x-ray flux comparing a tantalum target with thickness of 2 and 4 microns. The commonly held belief is that as the target thickness increases the amount of x-rays absorbed by the added thickness increases dramatically is supported by this limited data for two thin transmission targets. Thus when engineers skilled in the art have the option of choosing between transmission targets and reflection targets, they were careful not to use target thickness for transmission targets more than about 8 microns thick. Rather than simply looking at the number of photons produced, the quality of those photons must also be examined. Just observing FIGS. 5 and 6 it is clear that the difference between the flux at 40 kev and above is not substantially reduced at higher angles from centerline. The absorption of flux at the l-line emission portion of the curve is obviously much higher at lower energies than at higher energies. In most practical medical imaging and non-destructive x-ray tube applications the l-line is not needed or used.

One area of radiation physics that has received much attention concerns electron-photon transport in matter. PENELOPE is a modern, general-purpose Monte Carlo tool for simulating the transport of electrons and photons, which is applicable for arbitrary materials and in a wide energy range. It is maintained at the OECD Nuclear Energy Agency in France. PENELOPE provides quantitative guidance for many practical situations and techniques, including electron and x-ray spectroscopies, electron microscopy and microanalysis, biophysics, dosimetry, medical diagnostics and radiotherapy, and radiation damage and shielding.

Experimental situations amenable to detailed simulation are those involving either electron sources with low initial kinetic energies (up to about 100 kVp) or special geometries such as electron beams impinging on thin foils. For larger initial energies, or thick geometries, the average number of collisions experienced by an electron until it is effectively stopped becomes very large, and detailed simulation is very inefficient. Hence even the most sophisticated simulation software for predicting the x-ray generation produced when electrons impinge a transmission target does not address thick targets or high electron energies above about 100 kVp.

In a paper titled "X-ray Tube Selection Criteria for BGA/CSP X-ray Inspection" written by David Bernard and published in The Proceedings of SMTA International Conference, September 2002 it was disclosed that "This is particularly important for transmission targets as a trade off needs to be made to provide good x-ray flux for commercial applications (i.e. long lifetimes) whilst at the same time not self-absorbing too much of the x-rays as they pass through (the target)." This is paramount to stating that the thinner the target the less the target absorbs x-rays produced inside the target.

In another paper entitled "Transmission-type Microfocus X-ray Tube Using Carbon Nanotube Field Emitters, published in Applied Physics Letters 90, 183109_2007_ the authors disclosed, "If the thickness of the target material is smaller than the range of incident electron, electrons can pass through the target, causing only a part of the electron energy to be converted into x rays. Hence, sufficiently thick target material is required for increasing the conversion efficiency of electron energy to x-ray energy. However, as the thickness of the target material increases, x-ray attenuation becomes significant during the penetration of x-rays through the target. This suggests that an optimum target thickness exists to produce maximum x-ray intensity for a given beam current and that the optimum thickness depends on the incident electron energy. The x-ray intensity as a function of W thickness was calculated using a particle transport code _MCNPX. On the base of the calculation result, the coating thickness of W on the Be window was determined to be 1.1 micrometers to produce maximum x-ray intensity at 40 keV electron energy." No attempt was made to analyze the spectral composition of the output x-rays.

In yet another paper Titled "Optimization of X-ray target parameters for a high-brightness microfocus X-ray tube" published in Nuclear Instruments and Methods in Physics Research B 264 (2007) 371-377, the authors concluded in FIG. 2 of the paper that the optimal thickness for a transmission tungsten transmission target with a tube voltage 30 kVp is about 1 micron increasing to 8 microns for a Tungsten at a tube voltage of 150 kVp. This again represents the recently published common sense regarding choosing the optimum target thickness for a transmission type x-ray tube.

The common sense of those skilled in the art is that, as the target thickness of a transmission target increases, the amount of x-radiation generated decreases because the thicker target material absorbs the x-rays produced inside the target, reducing the amount of radiation exiting the other side of the target and rendering the x-ray tube incapable of use. What is not considered is that the amount of absorbed energy is very much a function of the photon energy and that as bremsstrahlung radiation passes through the thick target much of the bremsstrahlung radiation is converted to useful characteristic radiation. There may be other phenomenon not yet explained resulting in increased useful x-radiation as the target material becomes thicker. Neither Penelope nor any other published literature provides much assistance as they are limited to low electron energies and/or thin targets.

Table 2 below illustrates the ratio of energy absorbed by x-rays passing through pieces of tantalum foil 50 microns and 100 microns thick. $I/I_o$ is a measurement of the x-ray photon flux which passes through (I) a tantalum sheet 50 microns thick and a tantalum sheet 100 microns thick compared to the amount of x-rays ($I_o$) which enter the foil.

TABLE 2

Tantalum as a Thick Target Material

| Photon Energy | $I/I_o$ at 50 μm | $I/I_o$ at 100 μm |
|---|---|---|
| 150 kev | 88% | 77.50% |
| 100 kev | 69.90% | 48.90% |
| 80 kev | 53.20% | 28.30% |
| 70 kev | 40.20% | 16.20% |
| 67.46 kev high | 37.40% | 14.00% |
| 67.46 kev low | 80.20% | 64.30% |
| 60 kev | 74.30% | 55.20% |
| 56.278 kev k-α | 68.10% | 46.40% |
| 40 kev | 42.60% | 18.10% |
| 30 kev | 16.20% | 2.62% |
| 20 kev | 0.50% | 0% |
| 10 kev | 0% | 0% |

K-edge describes a sudden increase in the attenuation coefficient of photons occurring at a photon energy just above the binding energy of the K shell electron of the atoms interacting with the photons. The sudden increase in attenuation is due to photoelectric absorption of the photons. The photoelectric absorption is countered by the emission of k-line x-rays which are very useful in x-ray imaging and non-destructive testing applications.

For this interaction to occur, the photons must have more energy than the binding energy of the K shell electrons. A photon having an energy just above the binding energy of the electron is therefore more likely to be absorbed than a photon having an energy just below this binding energy.

No attempt was made in this table to predict the additional amount of k-line and l-line x-rays which would be produced by absorbing x-rays with energies above the k-edge and l-edge of tantalum. The table is simply a prediction of how much x-radiation would pass through a piece of tantalum foil and how much would be absorbed as a function of the input energy of the x-rays in kev and the thickness of the foil.

This table shows the important finding that a target 100 microns thick will absorb no more than 35.7% of all of the energy just below k-edge generated by the target. Thus a simple incrase of 25% in tube current to produce x-rays will provide the same amount of x-rays exiting a target foil 50 microns thick. Yet not even that is needed because of the considerably higher amount of absorbed photons just about k-edge that are available to be converted to k-alpha radiation.

For the element tantalum k-edge occurs at 67.46 kev of photon energy. In Table 2 "67.46 kev high" represents the absorption coefficient just above k-edge. "67.46 kev lo" represents the absoprtion of x-ray energies just below k-edge. For a tantalum foil 50 microns thick the ratio of x-ray energy which passes out the other side (I) of the target compared to the amount of x-ray energy which enters the foil ($I_o$) is shown to be 80.20% just below k-edge for tantalum and 37.40% just above k-edge. Thus just below k-edge for a 50 micron thick tantalum target 80.20% of energy is passed through without being absorbed and hence provides useful x-rays for imaging and non-destructive testing applications. However, 62.60% of the photons with energy just above k-edge are absorbed by the tantalum foil. When the foil becomes the target of an x-ray tube it produces additional k-alpha radiation when the x-ray energies above k-edge are absorbed, thus adding to the amount of useful x-radiation. For a tantalum target 100 microns thick the amount of energy passed is 64.30% but the amount of energy absorbed by the K-shell electrons increases to 86%. When used as a target of the current invention the additional 50 microns add additional material in which the high energy x-rays are absorbed and useful k-line x-rays are produced.

It is obvious from Table 2 that a target 100 microns thick has major advantages in reducing the amount of x-radiation 40 kev and lower as well as absorbing higher percentages of energy above k-edge. This provides a double advantage of decreasing lower energy x-rays which only serve to increase dose without adding to the imaging capability of the x-ray tube and absorbing higher energy x-rays which pass through the thicker target material producing additional k-alpha radiation. Although tantalum is used here for purposes of illustration, other target elements behave in the same manner with k-edge different for each target material.

What is remarkable is that the amount of total impinging energy absorbed by the foil just below k-edge is only 19.8% for a 50 micron thick foil and 35.7% for a 100 micron thick foil. The 100 micron thick target absorbs considerably more energy higher than the k-edge value than does the 50 micron thick target. The energy absorption mechanisms for energy above k-edge includes additional generation of k-alpha radiation. This additional k-alpha radiation would be higher for the 100 micron thick target compared to the 50 micron thick target, adding useful x-rays as k-alpha radiation. This phenomenon is clearly illustrated in FIG. 4. As the target thickness is increased from 25 to 130 micron thick tantalum, the percentage of x-radiation between 55 and 60 kev ($k_\alpha$ for tantalum is 56.278 kev) increases steadily as the targets become thicker. This can be explained by the additional k-alpha radiation being generated from energy above k-edge. Although the amount of x-radiation absorbed by the target just below the k-edge is small, as thicker targets are used additional tube current may be required to maintain the proper level of x-rays required for the x-ray application. If tube current is increased the amount of heat to be removed from the surface of the target increases. Thus is applications where the amount of total output flux of x-radiation is critical, additional steps may be required to remove the heat generated by additonal tube current.

To remove excess heat, transmission tubes can readily take advantage of impinging high pressure fluids onto the opposite side of the end window from where the electrons impinge the target. Transmission tubes are particularly well suited to removal of heat by forcing turbulent liquid flow over the surface of the end window. Because the heat can be removed very close to where heat is generated, the temperature rise on the vacuum side of the target can be minimized. Similarly it is well known that with a thick target tube, the heat distribution of the electrons impinging the target spreads out as the electrons enter the thick target. This spreading of the heat reduces the temperature rise at the point where the electrons impinge the target in the focal spot and allow for higher tube currents. In the tube of the current invention the thickness of the end window substrate can be as thin as about 100 to 250 microns allowing for removal of heat generated by the electron beam with liquid cooling about 150-450 microns from the beam spot on the target. Because the heat flux impinging the target can be very high, when a liquid coolant is used to remove heat, maximum use should be made of a phase change from liquid to vapor near the spot of electron impingement.

The industry standard x-ray tube used for mammography imaging is a reflection type x-ray tube of FIG. 2 made with a molybdenum target and an additional 30 micron thick molybdenum filter positioned outside of the tube vacuum to significantly alter the output of the reflection tube spectrum and increase characteristic k-alpha radiation from the molybdenum target. It does so at an undesirable increase of filter blur since the filter was added outside the tube typically at a distance of more than 15 mm from the place where the electrons impinged the reflection target.

In an effort to examine the use of transmission x-ray tubes for the mammography imaging market if a transmission tube were used the filter could be part of a thick target and hence filter blur could be significantly reduced compared to the reflection type tube. A 25-micron thick molybdenum target was made as the target for a transmission tube according to those knowledgeable in the production of transmission tubes. The thick molybdenum target would act as its own filter and the filter would be so close to the spot where x-rays were generated, x-ray image quality should be improved. However, because of the common sense that thicker targets would filter their own x-rays, the target thickness was limited to 25 microns. Such an experimental tube was made and the output spectrum analyzed.

Figure 10A:
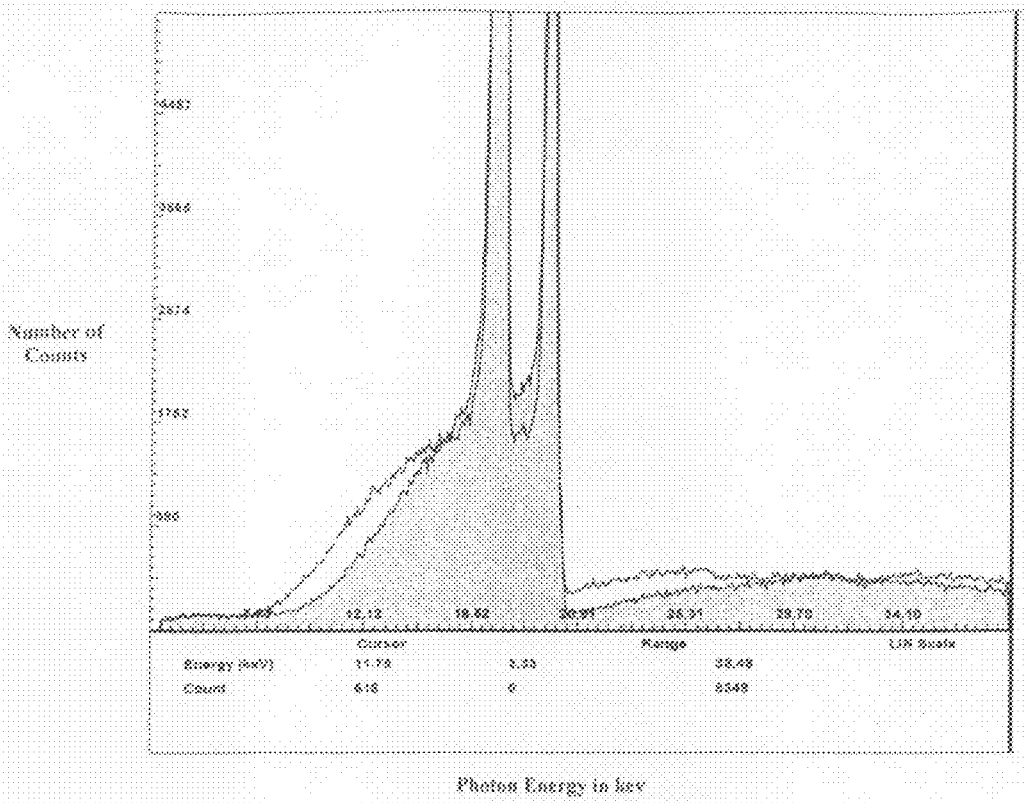
FIGS. 10A and 10B are two different representations of the same data from a transmission x-ray tube with a molybdenum target 25 microns thick at centerline and at 60 degrees from centerline.
Figure 10B:
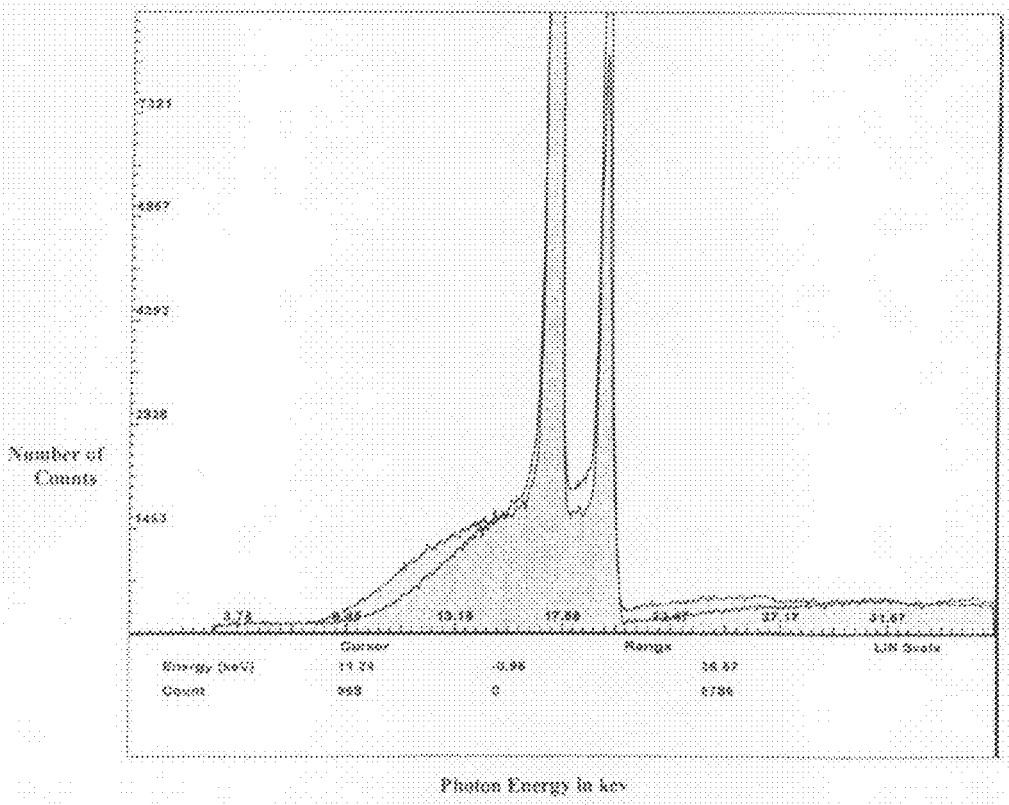

FIG. 10A shows the spectrum of the 25 micron molybdenum x-ray tube target taken at 0 degrees from the tube's centerline and at 60 degrees with a tube voltage of 60 kVp. The shaded area in the superimposed images is the spectrum at 60 degrees. So that the figures could be compared easily the collimator for the Amptek spectrometer was increased from 200 microns diameter at center line to 400 micron diameter at 60 degrees from centerline. FIG. 10 B shows the same two spectrum but the shaded area is the spectrum at centerline. The quality of the spectrum at 60 degrees was superior to that at 25 microns. There was less low energy x-radiation or dose and there was more x-radiation in the energy band including k-alpha and k-beta energies for molybdenum. This was contrary to commonly held belief in prior art that thicker target material for transmission tubes is not appropriate.

In one preferred embodiment of the current invention a molybdenum target 50-55 microns thick was attached to a beryllium end window 2 mm thick. The x-ray spectrum was compared to the spectrum from a commercially available mammography x-ray tube and the x-ray tube of FIGS. 10A and 10B with a 25 micron thick target. The table below shows the percentage of flux for each tube in energy bands from 3-10 kev, 10-16.83 kev, from 16.83 to 20.5, the energy band containing the k line characteristic of molybdenum, and greater than 20.5 kev. X-ray spectrums were measured for the 50-55 micron thick target at centerline and at 45 degrees from centerline. The target thickness would in effect be 40% thicker at 45 degrees from centerline.

TABLE 3

| | Percent of Energy in Each Energy Band | | | |
|---|---|---|---|---|
| | 3-10 kev | 10-16.83 kev | 16.83-20.5 kev | >20.5 kev |
| Commercial Tube-27 kVp | 2.50% | 43.80% | 49.50% | 4.10% |
| 25Mo 0 Deg-27 kVp | 3.40% | 47.40% | 44.60% | 4.50% |
| 25Mo 60 Deg-27kVp | 1.70% | 38.70% | 55% | 4.60% |
| 50-55Mo 0 Deg-27kVp | 0.90% | 32.90% | 62.60% | 3.60% |
| 50-55Mo 45 Deg-27kVp | 0.30% | 23% | 74.40% | 2.20% |
| 50-55Mo 0 Deg 30kVp | 0.80% | 28.70% | 64.90% | 5.70% |
| 50-55Mo 45Deg 30kVp | 0.25% | 21.80% | 73.70% | 4.20% |
| 50-55Mo 0Deg 35kVp | 0.90% | 21.90% | 66% | 11.30% |
| 50-55Mo 45Deg 35kVp | 0.70% | 15.50% | 75.60% | 8.10% |

The commercially available tube was a reflection type tube with a molybdenum target and a 30 micron thick molybdenum filter through which the x-rays pass prior to imaging the breast. The spectrum data was taken at centerline for that tube. Data from the tube with a 25 micron thick molybdenum target are shown at centerline and at 60 degrees from centerline. It is remarkable that for the 50-55 micron molybdenum target of the current invention, operated at 30 kVp and 35 kVp and 45 degrees from centerline there was a marked decrease of about 60% in the total flux of energies lower than 16.83 kev significantly reducing the amount of dose a patient would receive during routine mammograms from reflection tubes. At the same time there is an increase of about 50% in the amount of flux in the characteristic k-line energy range for molybdenum of 16.83 to 20.5, critical for high quality imaging of the breast. The ratio of flux for the commercial reflection type tube between 16.83 and 20.5 (49.50%) compared to the unnecessary flux between 3 and 16.83 kev (46.3%) is considerably inferior to that of the 50-55 micron target at 45 degrees from center line for a tube voltage 30 kVp (73.7% between 16.83 and 20.5 kev and 22.05% below 16.83) and 45 degrees from centerline for the same tube operated at 35 kVp (75.6% between 16.83 and 20.5 kev and 16.2% below 16.83 kev). This is done while operating the tube at a higher voltage than the commercially available tube providing considerably higher flux for similar tube currents.

Figure 12:
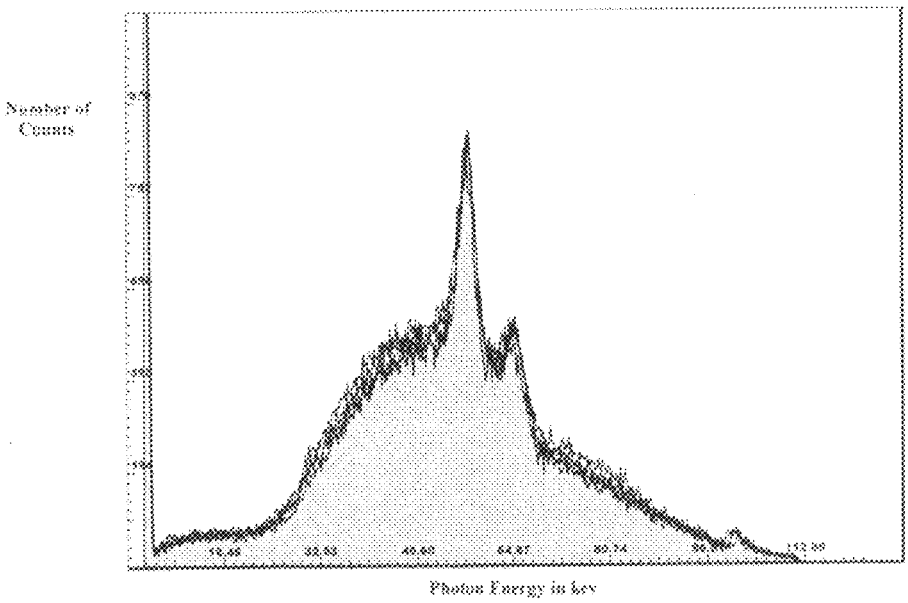
FIG. 12 is a series of spectrum taken at centerline, 10 degrees, 20 degrees and 30 degrees from a transmission tube with a 25 micron thick tantalum target attached to a 6.35 aluminum end window with all spectrum superimposed.

A transmission x-ray tube with a target material of tantalum and a target thickness of 25 microns deposited on an end-window of aluminum 6.35 mm thick was built and tested. As the angle of measurement changed from the centerline (0 degrees) of the tube to 10 degrees, 20 degrees and 30 degrees from centerline there was virtually no difference in the measured spectrum for each of the voltages tested 80, 90, 100, 110, and 120 kVp. This is contrary to all of the common sense of experts in the field. The x-rays passed through a target thickness of 38.8 at 30 degrees compared to 25 microns at centerline. The x-rays also passed through and additional 1 mm of Aluminum at 30 degrees compared to that at centerline. There was no consistent decrease in the x-radiation especially as the angle of measurement changed from 0 to 30 degrees especially at the characteristic k-alpha line of tantalum 57.5 kev. FIG. 12 is a superimposition of all spectrum of the above specified tube operated at 120 kVp tube voltage at angles of 0, 10, 20 and 30 degrees from centerline. Especially noticeable is that the curves for the output flux in the k-alpha energy range from 55 kev to 60 kev are virtually the same. Also of note is that the there is there is a steep decrease of output flux at the k-edge of tantalum, hinting that higher bremsstrahlung x-ray energies which enter the thick target are absorbed and at least some are converted into characteristic k-line radiation.

TABLE 4

| | 80 kVp | 90 kVp | 100 kVp | 110 kVp | 120 kVp |
|---|---|---|---|---|---|
| 0 Deg. | 62,451 | 90,400 | 147,474 | 201,884 | 263,384 |
| 10 Deg. | 56,060 | 87,580 | 125,669 | 152,704 | 201,308 |
| 20 Deg. | 60,408 | 93,027 | 123,921 | 169,700 | 244,687 |
| 30 Deg. | 57,640 | 87,022 | 135,674 | 159,055 | 208,071 |

Table 3 is a compilation of the spectral data taken with the above outlined configuration. The total number of counts at each angle and each tube voltage are shown in the table. Aside from there being very little change in the x-ray output within 30 degrees of centerline, it was remarkable that the amount of x-ray flux at centerline increased 4.2 fold for a 2 fold increase in tube voltage, hinting that higher voltages and thicker targets would produce even more output flux. This provides special advantage in that total output flux can be increased by increasing the accelerating voltage (kVp) of the tube with a less than proportional increase in heat load on the x-ray target. Another phenomenon assisting this decrease in heat load is that the thicker the target the more load spreading and hence lower surface temperature of the target where electrons impinge the target.

In three different preferred embodiments of the current invention transmission x-ray tubes of the current invention were made with tantalum targets 50, 65 and 130 microns thick. Although this illustration uses tantalum as target material, the target material could be any of a number of different materials suitable for use as x-ray transmission targets including but not limited to scandium, chromium, tin, antimony, copper, lanthanum, titanium, iron, nickel, yttrium, molybdenum, rhodium, palladium, gadolinium, erbium, ytterbium, thulium, tantalum, tungsten, rhenium, platinum, gold and uranium and an alloys, eutectic alloy, compounds or intermetallic compounds thereof. When alloys, intermetallic compounds, eutectic alloys, or compounds of one of the materials listed above is used for that target foil, the target will generate characteristic x-ray line emissions from at least one of the target elements.

Prior art consistently holds that such thick targets are inferior as they absorb too much of the x-radiation generated inside the target by impinging electrons. No attempt has ever been made to examine the quality of the radiation for specific applications. In the current invention not simply the total amount of output x-radiation is examined. When the quality of the output spectrum is examined for use in various applications, it is clear that thick targets 50 microns and above provide a significant breakthrough in the application of transmission tubes to medical imaging including C-arm applications, Dental CT applications, upper and lower body x-ray imaging, computed tomography applications in the medical field. In non-destructive testing (NDT) applications such electronic circuit imaging, electronic chips imaging, fluorescent analysis, x-ray microscopy, computed tomography imaging, x-ray diffraction as well as other well known by those skilled in the art.

It is well known that when electrons enter the surface of the target material, depending on the density of that material, the maximum penetration depth of the electrons is determined by the energy of the impinging electrons. When electrons impinge tantalum for example at 100 kev the penetration depth is on the order of 8 microns and at 150 kev it is close to 16 microns. The penetration depths for less dense materials such as chromium are 20 microns for 100 kev and 37 microns for 150 kev energies respectively. The penetration depth of the electron with subsequent x-ray generation at deeper levels cannot fully explain the reason for the improvement in the output of x-rays at target thickness greater than 50 microns thick.

In one preferred embodiment of the current invention diffusion bonding is utilized to attach the thick target foil to the end-window substrate. Diffusion bonding involves holding pre-machined components under load at an elevated temperature usually in a protective atmosphere or vacuum. The loads used are usually below those which would cause macrodeformation of the parent material(s) and temperatures of 0.5-0.8 Tm (where Tm=melting point in K) are employed. Times at temperature typically range from 1 to 60+ minutes.

Diffusion-bonded joints are particularly pliable yet remain strong and thus are able to endure extremes in temperature. Even where the joined materials have mismatched thermal expansion coefficients, the joints are totally reliable. Diffusion bonding is therefore particularly suitable for applications threatened by thermal shock at high service temperature such as the case whereby electrons impinge the target of the current invention.

Figure 11:
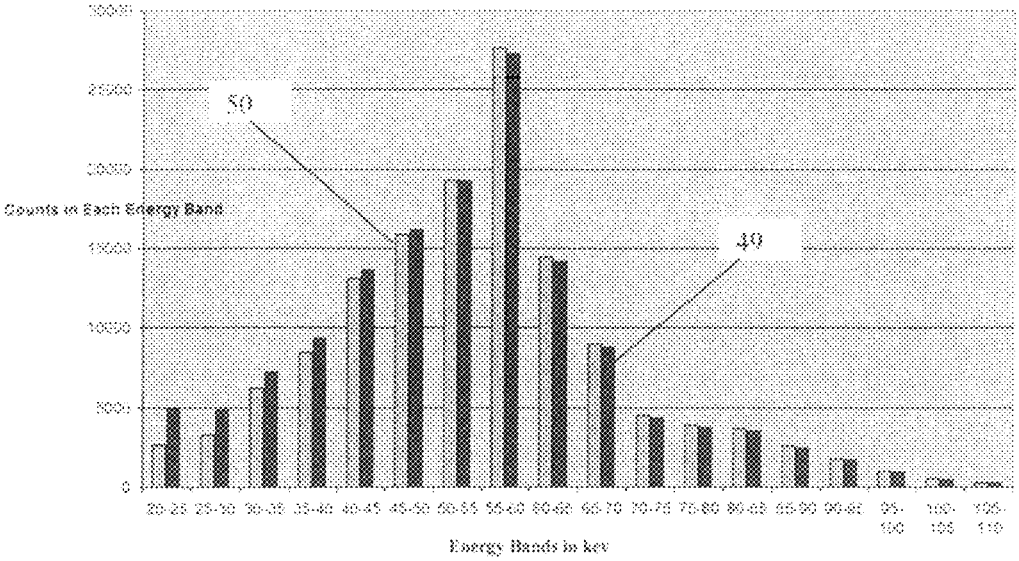
FIG. 11 is a graphical representation of a comparison of the output spectrum from an x-ray tube of the current invention with a 130 micron thick tantalum target and using both 2 mm of aluminum and 1 mm of beryllium end window.

In one embodiment of the current invention the end-window material is chosen to be 2 mm thick aluminum. The aluminum is diffusion bonded or hot pressed to a stainless steel frame used to hold the end window in place and form a vacuum seal between the inside of the tube and the outside atmosphere. In one embodiment of the current invention a thick target made of 130 microns thick tantalum is also diffusion bonded or hot pressed to the vacuum side of the aluminum end window. FIG. 11 compares the output spectrum of an x-ray tube of the current invention with a 130 micron thick tantalum target and a 2 mm thick aluminum end-window, Item 50, to a similar x-ray tube where the end-window is made of 1 mm of beryllium, Item 49. The total output of both tubes has been normalized between 40 and 70 kev so that they are equal. In order to provide the same x-ray intensity x-rays in the energy bands from 40 to 70 kev, however, the tube current of the tube with an aluminum end window needs to be increased by some 8%. Clearly the aluminum end-window provides considerably less dose than the equivalent beryllium end window. In some medical applications this decrease of dose at low energies is more critical than the increased energy required to operate a similar tube with a beryllium end-window. Placing the aluminum filter so close to the spot size significantly reduces filter blurring compared to filers placed on the atmospheric side of the x-ray tube either reflection or transmission type. Although a 2 mm thick aluminum end window is used to illustrate this embodiment, other end window materials and thickness can be substituted to obtain similar results. Although hot press and diffusion bonding is preferred, any method of attaching aluminum to both the x-ray tube frame and the target material can be substituted by those skilled in the art.

Solid-phase diffusion bonding can also utilize ductile interlayer materials with low out-gassing rates to join the metallic materials of the target foil and substrate of the current invention. The resulting bond is devoid of inclusions. Any of a number of possible interlayer materials can be used well known by those skilled in the art of diffusion bonding. It is prudent to chose the melting temperature of the ductile interlayer not to exceed the melting temperature of either the target foil material or the substrate material.

Alternatively either sputtering of the target foil onto the substrate or attaching the target foil by means of Hot Isotatic Pressing (HIP) wherein much higher pressures are used (100-200 Mpa) to attach the surfaces may be used. The high pressures of bonding with HIP allow surface finishes which are not so critical. Finishes of 0.8 μm RA and greater can be used.

In one embodiment of the current invention a focused transmission tube is used to produce x-rays with a focal spot size of about 0.1 microns to 3 mm for use in fluoroscopic measurement of the presence and concentration of elements in an object to be measured. Preferred spot sizes are usually between 3 microns and 200 microns. The output of an x-ray tube is collimated into a small beam of x-rays impinging the object to be analyzed, utilizing only a small portion of the beam and constraining x-ray fluorescence to the radiated portion of the object. If the location of radiating x-ray beam is known and varied, a map showing presence and concentration of one or more elements of interest can be produced well known by those skilled in the art. Using a transmission tube with thick target foil has many advantages over the use of reflection tubes and the use of transmission tubes of less target thickness. Significantly higher percentages of k-alpha x-radiation of the precise energy required to excite a specific element of interest in the object can be produced at higher tube voltages than can be produced by reflection tubes. The collimator can be located very close to the x-ray spot, typically within 1 or 2 millimeters compared to about 20 to 30 millimeters for reflection tubes, significantly reducing the $1/r^2$ losses of x-ray beam intensity of the reflection tube. The collimator also acts to remove harmful high energy x-radiation which is absorbed in the walls of the collimator.

In another preferred embodiment of the current invention, a single thick target foil made from an alloy, eutectic alloy, compound or intermetallic compound of two or more elements is provided. It is well known that layering target materials or using multiple targets and selectively moving the electron beam from one to the other, can produce x-rays containing useful characteristic lines of more than a single element but at added cost. However mixing two or more elements into a single target avoids such cost. Foils made of such alloys or compounds can be purchased readily and with either diffusion bonding, hot compression or HIP methods to attach the thick foil to the end window. An alternative is to sputter the two elements simultaneously to form the thick target foil directly onto the end window.

With different characteristic x-ray emission lines, by successively varying the tube voltage the percentage of characteristic radiation from each of the elements comprising the alloy or compound can be changed providing a useful way to image or identify a specific compound in the object to be examined by those skilled in the art.

Such thick foils can address many problems with using just one element in the foil. Low melting points, poor heat conductivity, highly reactive materials which are difficult to manage in a production environment are just a few of the many problems that can be resolved by mixing the element to provide useful characteristic radiation with other elements.

Example using Lanthanum/Tin: Iodine is often used as an imaging agent in angiography, CT imaging and mammography among others. After giving a patient an Iodine-based imaging agent, taking one x-ray image with a high percentage of Lanthanum K-alpha (33.440 keV) and a second with a high percentage of tin k-alpha (25.270 keV) then subtracting the images will result in a clear image of the iodine with a K-absorption of 33.164 keV. Similarly dual imaging of the tin content in solder can be accomplished with the same two elements, Lanthanum and Tin to provide a quality control tool for soldering operations. An intermetallic compound comprising 60% Lanthanum and 40% Tin provides one example of any number of possible target materials with sufficient amounts of each material to produce high intensity K-line x-rays for both elements.

Quantities of K-alpha radiation from each element are adjusted by varying the x-ray tube voltage.

Figure 7:
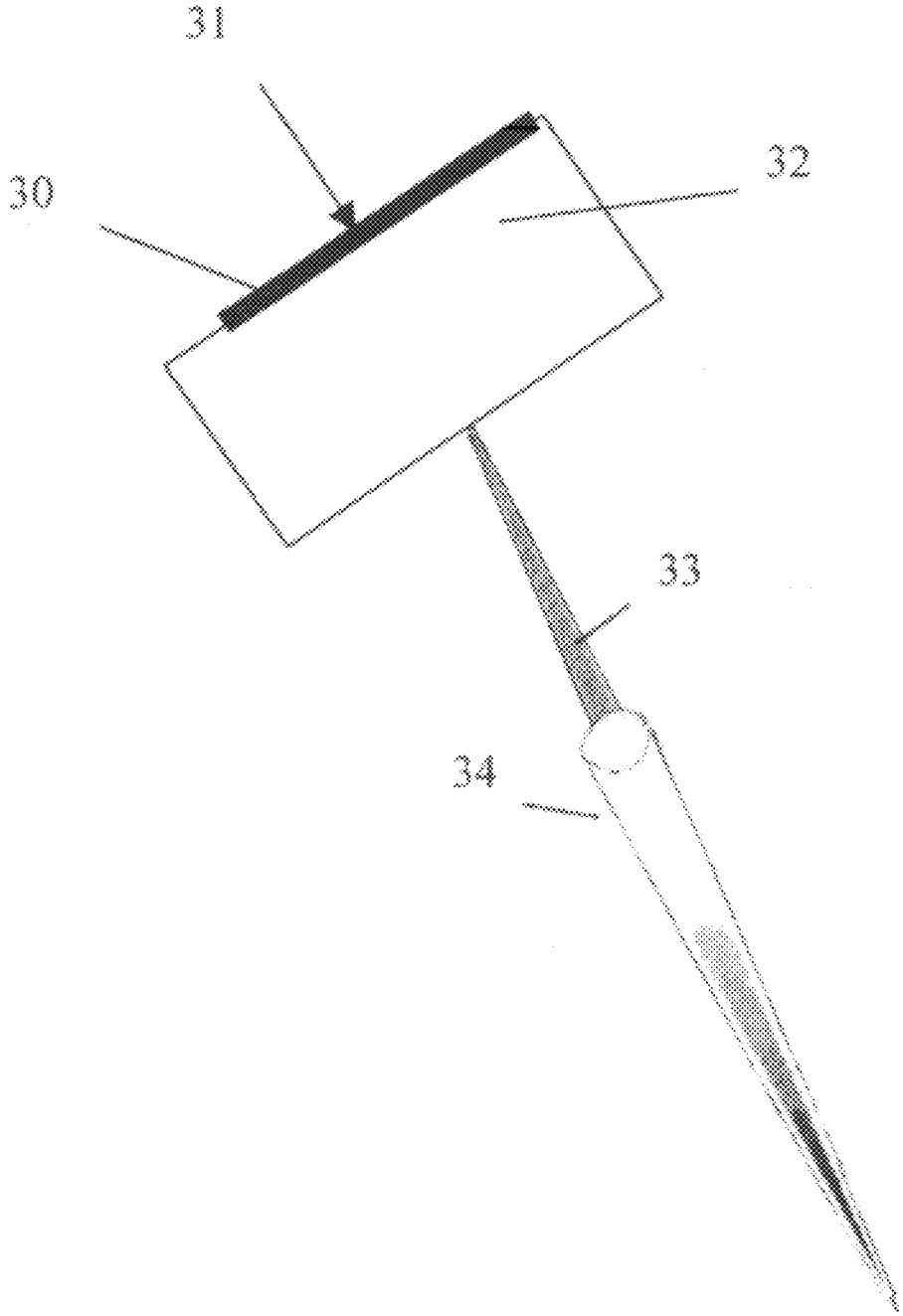
FIG. 7 is a schematic, elevational, cross sectional representation of a glass capillary being use to capture photons from a tube of the current invention and to focus them at a different location in space.

In one preferred embodiment of the current invention a transmission tube of this invention is coupled to a single capillary or a bundle of capillaries, typically made of specialty glass well known to those skilled in the art or any suitable material as well, which guide and focus a portion of the x-rays produced by a transmission type x-ray tube. FIG. 7 represents a single capillary coupled to the output of a transmission type tube, Item 31 representing a focused electron beam of a transmission tube striking the target Item 32 in a focal spot. The target deposited on an anode substrate Item 30 generates a beam of x-rays Item 33 a portion of which exit the end-window and enter a single capillary Item 34 to exit the opposite end of the capillary. Typically such a single capillary is used to focus the x-rays from a focal spot of about 20 to 150 microns diameter to a very narrow beam of x-rays on the order of 1-10 microns, however the tube spot size and the size of the narrow beam of output x-rays does not limit this application in any way. Similarly the target material or materials can be chosen to provide the highest efficiency fluorescent analysis.

Figure 8:
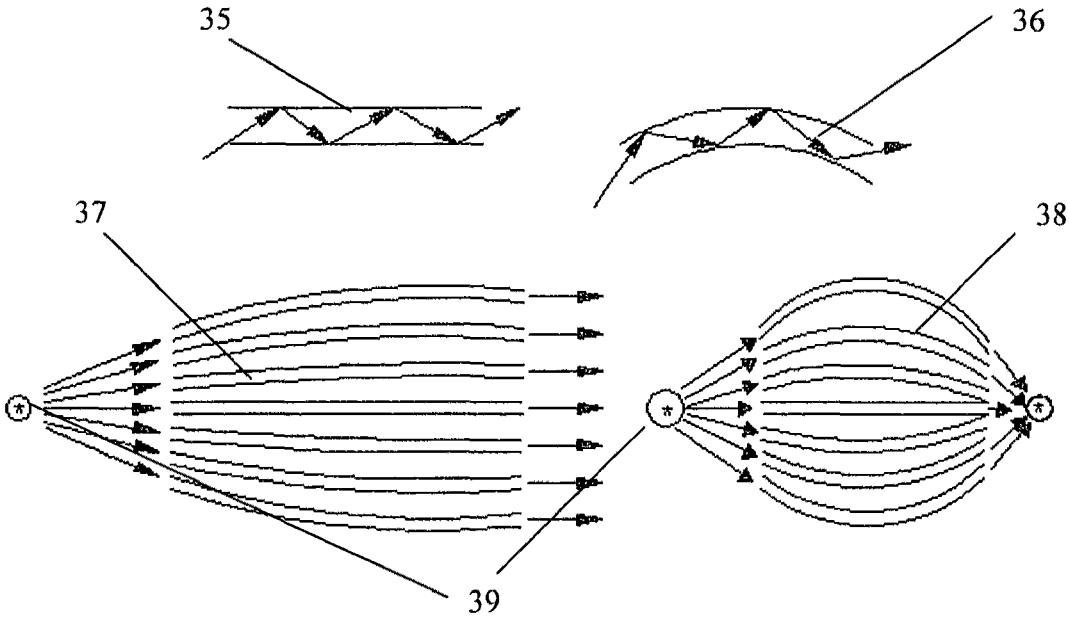
FIG. 8 is a pictorial representation of using a single capillary or bundled capillaries to guide the output of the x-rays from a tube of the current invention.

FIG. 8 represents a bundle of capillaries used to focus the spot size of an x-ray tube to produce even higher resolution of the x-ray beam useful for diffraction, fluorescence and imaging or to provide a close to parallel beam of x-rays to reduce scattering inside the object. X-rays are generated at the focal spot of a transmission target this invention, Item 39. Item 37 illustrates how a bundle of capillaries can receive x-rays from a point source and guide them into a nearly parallel beam of x-rays. Items 35 and 36 are graphical representations of how an individual x-ray beam travels inside a single capillary within the capillary bundle. Item 38 illustrates use of a bundle of capillaries to receive x-rays and refocus them at a second point in space. However, this invention is not limited to those two uses.

Although the transmission losses inside the capillary or capillaries are increased because the spot where x-rays are generated is place close to the entrance of the capillary in a transmission tube, these losses are not as great as the savings in x-ray intensity due to normal $1/r^2$ losses not realized inside the capillary. Using a transmission tube allows placement of the capillaries as close as about 0.075 to 2 mm, the thickness of the end-window, increasing significantly the intensity of x-radiation exiting the capillary compared to that from reflection tubes where placement is limited to a minimum of about 20 to 30 mm. Other advantages of transmission tubes with thick foil targets include a high percentage of characteristic line emission compared to reflection tubes and thin foil transmission tubes described above.

Figure 9:
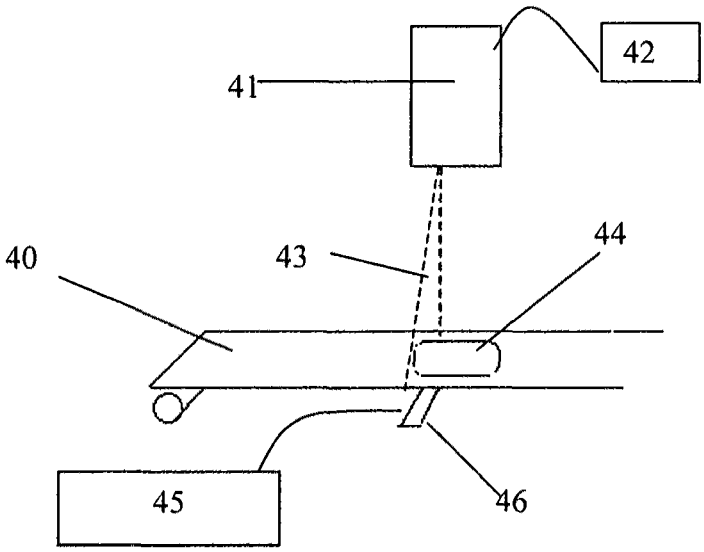
FIG. 9 is a schematic representation of the use of an x-ray tube of the current invention to perform inline inspection of objects using an automated material handling system.

In one preferred embodiment of the current invention a transmission type tube of this invention is used to provide x-rays for automated in-line inspection of objects. Objects are fed into the inspection station, inspected and then removed automatically by a material handling apparatus. FIG. 9 represents one such application. A conveyor belt 40 feeds products 44 which can be stopped during the inspection or move continuously through the station. However, any material handling apparatus well known to those skilled in the art can also be employed. In FIG. 9 a line sensor 46 well known by those versed in the art is used to sense the image and an image processor 45 collects a series of line images and transforms them into an image of the object. A power supply 42 provides electrical power to the x-ray tube assembly 41 conventionally containing the x-ray tube immersed in a cooling and electrically isolating fluid. The x-ray tube produces x-rays 43 used to produce x-ray images of the product. Although this particular representation shows a line image sensor, various sensors, well known by anyone skilled in the art, can be used either for imaging or fluorescence analysis or a combination thereof.

As shown in FIGS. 1 and 2 the cone angle of x-rays produced 8 is considerably wider for a transmission x-ray tube than for a reflection tube. Reflection type x-ray tubes are typically placed 35 cm from the conveyor. Transmission type tubes of the current invention can provide the same field of inspection at distances as close as 20 cm or closer depending on the size of product being examined, decreasing the amount of x-ray flux needed and significantly reducing the heat load on the x-ray target.

Using a transmission tube with the target thickness, target material and subsequent tube voltage optimally chosen for the sensor used in the in-line application can provide a three to five-fold improvement in total x-ray flux at the critical x-ray imaging energy compared to reflection tubes. This is added to the advantage of placing the x-ray tube closer to the object being imaged, decreasing the total energy consumption by a factor of 10 or more. Because of the speed required of in-line inspection stations, spot sizes of less than 1 mm have not been widely used. The considerable performance improvements offered by a transmission tube of this invention allow for spot sizes of less than 200 microns with resultant higher system resolution without seriously slowing line speed.

The x-ray tube of the current invention may be used to provide x-rays with a high concentration of k-alpha emission. In diffraction applications the x-rays produced by an x-ray tube must first be made monochromatic. Thick targets produce extra high amounts of k-alpha radiation from the target material because a high amount of the low energy energies there is considerably more absorption of x-rays above the k-edge of the target material. That absorbed energy is used to generate more k-alpha inside the target. In diffraction copper is often the target material of choice. By combining a copper end-window with the copper target the entire end window becomes the target. Thickness of more than 300 or 400 microns with tube voltages in kVp well above two times the k-alpha in kev provides an excellent source of quasi-monochromatic k-alpha radiation. Although copper provides such a tube useful for x-ray diffraction there other end-window/target combined elements have use in other applications. In such applications the thickness of the end window/target should be on the order of 500 microns maximum. The minimum thickness should be thick enough to preserve the vacuum between the inside of the x-ray tube and outside atmosphere. The end-window/target may be attached to the frame of the x-ray tube by an means well known to those skilled in the art.

An X-ray microscope generally is made by placing a Fresnel zone plate between the object and the imaging sensor. Quasi-monochromatic x-rays impinge on the object x-rays, pass through the object and are then focused into a very small image spot providing resolution of detail in the object on the order of tens of nanometers. For such an x-ray microscope a high amount of monochromatic x-rays are needed to provide a clear image in a short amount of time. Such microscopes are often found at synchrotron centers which can produce very high quality monochromatic x-rays. However, for commercial applications the x-ray tube of the current invention can provide considerably higher amounts of quasi-monochromatic x-rays to be focused by the Fresnel plate to an economically viable high resolution image.

The invention claimed is:

1. A transmission x-ray tube comprising:

an evacuated housing;

an end window anode disposed in said housing comprised of an end window substrate and a thick target comprising a foil or a plurality of foils;

a cathode disposed in said housing which emits an electron beam, which proceeds along a beam path in said housing to strike said anode in a spot, generating a beam of x-rays which exits the housing through the end window substrate; and a power supply connected to said cathode providing a selected electron beam energy and beam current to produce a bright beam of x-rays of at least one pre-selected energy characteristic of the foil or the plurality of foils of the thick target, wherein the thickness of the foil or at least one of the plurality of foils of the thick target is greater than 70 microns.

2. A transmission x-ray tube according to claim 1, wherein the thickness of the foil or at least one of the plurality of foils of the thick target is more than 70 microns but equal to or less than 200 microns.

3. A transmission x-ray tube according to claim 1 where the beam energies are between 10 and 500 kVp.

4. A transmission x-ray tube according to claim 1, wherein the target and the end window substrate are made of a single material and are as thick as 500 microns.

5. A transmission x-ray tube according to claim 1 wherein the thick target is attached to the end-window substrate by means of diffusion bonding.

6. A transmission x-ray tube according to claim 1 wherein the thick target is attached to the end-window substrate by means of hot pressing or hot isostatic pressing.

7. A transmission x-ray tube according to claim 1 wherein the thick target is deposited on the end window substrate of a material substantially transparent to x-rays, and said material is selected from beryllium, aluminum, copper, lithium, boron, and alloys thereof.

8. A transmission x-ray tube according to claim 1, wherein the e-beam is focused above, below or onto the thick target by a focusing lens.

9. A method for x-ray fluoroscopy comprised of (a) providing a transmission x-ray tube according to claim 1, and (b) causing said x-ray tube to produce said source of generated x-rays for use in x-ray fluoroscopy.

10. A method for obtaining dental computed tomography images comprising (a) providing a transmission x-ray tube according to claim 1, and (b) causing said x-ray tube to produce x-rays to obtain said dental images.

11. A method for obtaining medical images comprising (a) providing a transmission x-ray tube according to claim 1, and (b) causing said x-ray tube to produce said source of generated x-rays to obtain said medical images.

12. A method for producing images by computed tomography comprising (a) providing a transmission x-ray tube according to claim 1, and (b) causing said x-ray tube to produce said source of generated x-rays that are used in producing images by computed tomography.

13. An apparatus comprising a transmission x-ray tube according to claim 1, and a C-arm having an x-ray source and image receptor at opposing ends to face each other along an x-ray beam axis.

14. A method for x-ray diffraction (a) providing a transmission x-ray tube according to claim 1, and (b) causing said x-ray tube to produce the predominately characteristic line x-rays.

15. An apparatus comprising a transmission x-ray tube according to claim 1 to provide a source of high concentration monochromatic x-rays for use in an x-ray microscope.

16. A transmission x-ray tube according to claim 1 where the material used for the foil or at least one of the plurality of foils of the thick target contains at least one of the elements including scandium, chromium, tin, antimony, titanium, iron, copper, nickel, yttrium, molybdenum, rhodium, lanthanum, palladium, gadolinium, erbium, ytterbium, thulium, tantalum, tungsten, rhenium, platinum, gold, and uranium.

17. A transmission x-ray tube according to claim 16 where the material used for the foil or at least one of the plurality of foils of the thick target includes an alloy, an eutectic alloy, a compound or an intermetallic compound of at least one of the elements to produce useful characteristic x-ray line emissions from said element.

18. A transmission x-ray tube for use in x-ray fluoroscopy comprising:

An evacuated housing either sealed after evacuation or continuously evacuated;

An end window anode disposed in said housing comprised of an end window substrate and a target of at least one thick foil attached to the end window substrate that is substantially transparent to x-rays, wherein said thick foil is greater than 70 microns thick and less than or equal to 200 microns thick or wherein the target and the end window substrate are made of a single material and are as thick as 500 microns;

A cathode disposed in said housing which emits an electron beam, which proceeds along a beam path in said housing to strike said end window anode in a spot, generating a beam of x-rays exiting the housing through the end window substrate; and A power supply connected to said cathode and anode providing a selectable electron beam energy between 10 to 500 kVp and selectable electron beam current to produce said beam of x-rays, wherein the e-beam is focused above, below or onto the target by a focusing lens, and collimation is used to guide the output x-rays to a location on the object being measured.

19. A transmission x-ray tube comprising:

An evacuated housing either sealed after evacuation or continuously evacuated;

An end window anode disposed in said housing comprised of an end window substrate and a target of at least one thick foil attached to the end window substrate that is substantially transparent to x-rays, wherein the thick foil is more than 70 microns thick and less than or equal to 200 microns thick or wherein the target and the end window substrate are made of a single material and are as thick as 500 microns;

A cathode disposed in said housing which emits an electron beam, which proceeds along a beam path in said housing to strike said end window anode in a spot, generating a beam of x-rays exiting the housing through the end window substrate; and A power supply connected to said cathode and anode providing a selectable electron beam energy between 10 to 500 kVp and selectable electron beam current to produce said beam of x-rays, wherein the e-beam is focused above, below or onto the target by a focusing lens, and wherein a capillary or bundle of capillaries is placed in proximity to the end-window substrate to collect at least part of said x-ray beam exiting the end window substrate and to guide x-rays to exit the other end of the capillary or bundle of capillaries.

20. An apparatus for examining objects in-line comprising:

A transmission x-ray tube with a focused electron beam providing a focal spot on a thick foil target disposed inside such tube producing a beam of x-rays which exits the tube through an end-window of the tube forming a cone of x-rays, wherein the thick foil target is more than 70 microns thick and less than or equal to 200 microns thick or wherein the thick foil target and the end-window are made of a single material and are as thick as 500 microns;

A power supply connected to said x-ray tube providing a selectable electron beam energy between 10 to 500 kVp and selectable electron beam current to produce said beam of x-rays, wherein said tube and objects to be examined are positioned such that objects to be examined are placed inside the x-ray cone for irradiation by such x-rays;

An automated material handling apparatus to introduce the objects into said x-ray cone for examination and to remove them after examination is complete; and At least one sensor placed in a location to sense x-rays which exit said object irradiated by x-rays from said transmission tube.

* * * * *